US010041665B2

(12) United States Patent
Chen et al.

(10) Patent No.: US 10,041,665 B2
(45) Date of Patent: Aug. 7, 2018

(54) HIGHLY EFFICIENT HEAT-DISSIPATING LIGHT-EMITTING DIODE LIGHTING DEVICE

(71) Applicant: ZHEJIANG SHENGHUI LIGHTING CO., LTD, Jiaxing (CN)

(72) Inventors: Fang Chen, Jiaxing (CN); Jinxiang Shen, Jiaxing (CN)

(73) Assignee: ZHEJIANG SHENGHUI LIGHTING CO., LTD., Jiaxing (CN)

( * ) Notice: Subject to any disclaimer, the term of this patent is extended or adjusted under 35 U.S.C. 154(b) by 0 days.

(21) Appl. No.: 15/543,981

(22) PCT Filed: Feb. 1, 2016

(86) PCT No.: PCT/CN2016/073056
§ 371 (c)(1),
(2) Date: Jul. 15, 2017

(87) PCT Pub. No.: WO2016/131378
PCT Pub. Date: Aug. 25, 2016

(65) Prior Publication Data

US 2018/0010780 A1 Jan. 11, 2018

(30) Foreign Application Priority Data

Feb. 17, 2015 (CN) ..... 2015 1 0085646

(51) Int. Cl.
*F21V 29/00* (2015.01)
*F21V 29/70* (2015.01)
(Continued)

(52) U.S. Cl.
CPC ..... *F21V 29/70* (2015.01); *F21K 9/232* (2016.08); *F21K 9/235* (2016.08); *F21V 29/86* (2015.01); *F21Y 2115/10* (2016.08)

(58) Field of Classification Search
CPC ..... F21V 29/70; F21V 29/86; F21V 9/232; F21V 9/235
(Continued)

(56) References Cited

U.S. PATENT DOCUMENTS 6,078,128 A * 6/2000 Gagnon ..... H01J 5/56 313/113
6,234,640 B1 * 5/2001 Belfer ..... G02B 6/0008 362/308
(Continued)

FOREIGN PATENT DOCUMENTS

CN 202791636 U 3/2013
CN 203131614 U 8/2013
(Continued)

*Primary Examiner* — Bryon T Gyllstrom
(74) *Attorney, Agent, or Firm* — Anova Law Group, PLLC

(57) ABSTRACT

The present disclosure provides a light-emitting diode (LED) lighting device. The LED lighting device includes a lamp base, a glass shell, a heat-dissipating cup, a driving power source, an LED light source module, and an optical portion. The LED light source module, the heat-dissipating cup, and the driving power source are arranged from top to bottom inside the glass shell. A top portion of the glass shell is connected to the optical portion and a bottom portion of the glass shell is connected to the lamp base. The heat-dissipating cup faces upwardly and an outer sidewall of the heat-dissipating cup forms a close contact with an inner sidewall of the glass shell. The LED light source module is fixed within the heat-dissipating cup. The driving power source is positioned under the heat-dissipating cup and a space is formed between the driving power source and the heat-dissipating cup.

13 Claims, 2 Drawing Sheets

(51) Int. Cl.

| | |
|---|---|
| ***F21K 9/232*** | (2016.01) |
| ***F21V 29/85*** | (2015.01) |
| ***F21K 9/235*** | (2016.01) |
| *F21Y 115/10* | (2016.01) |

(58) Field of Classification Search
USPC ..... 362/294
See application file for complete search history.

(56) References Cited

U.S. PATENT DOCUMENTS

| | | | | |
|---|---|---|---|---|
| 6,840,654 | B2 * | 1/2005 | Guerrieri | F21K 9/233 362/241 |
| 2006/0187662 | A1 * | 8/2006 | Nishida | H04N 9/315 362/299 |
| 2007/0285926 | A1 * | 12/2007 | Maxik | F21V 29/006 362/294 |
| 2010/0165630 | A1 * | 7/2010 | Lin | F21K 9/233 362/294 |
| 2012/0212960 | A1 * | 8/2012 | Rodriguez | F21V 29/02 362/249.02 |
| 2012/0319555 | A1 * | 12/2012 | Nakagawa | F21V 3/049 313/116 |
| 2014/0168992 | A1 * | 6/2014 | Xue | F21V 13/04 362/307 |

FOREIGN PATENT DOCUMENTS

| | | | |
|---|---|---|---|
| CN | 103925502 | A | 7/2014 |
| CN | 203893038 | U | 10/2014 |
| CN | 104654084 | A | 5/2015 |

* cited by examiner

HIGHLY EFFICIENT HEAT-DISSIPATING LIGHT-EMITTING DIODE LIGHTING DEVICE

CROSS-REFERENCES TO RELATED APPLICATIONS

This application is a national phase entry under 35 U.S.C. § 371 of International Application No. PCT/CN2016/073056, filed on Feb. 1, 2016, which claims priority of Chinese Patent Application No. 201510085646.9, filed on Feb. 17, 2015. The above enumerated patent applications are incorporated by reference herein in their entirety.

This application claims the priority of Chinese Patent Application No. 201510085646.9 filed on Feb. 17, 2015, the entire content of which is incorporated herein by reference.

FIELD OF THE DISCLOSURE

The present disclosure relates to the field of light emitting diode (LED) technologies and, more particularly, relates to a highly efficient heat-dissipating light-emitting diode (LED) lighting device.

BACKGROUND

Light-emitting diode (LED) lamps have advantages such as being energy-saving, environmental friendly, and providing controllable lighting. LED lamps are solid state devices, have long service time, and have been widely used in various lighting applications, e.g., lighting for public sites, business, and private homes. A main trend in the designs of LED lamps is to provide LED lamps with low cost and highly efficient heat-dissipating functions.

Existing heating-dissipating methods often include the following. For example, a highly heat-radiating coating is often deposited or coated on the surface of the heat sink of the LED lamp. The coating operations of the highly heat-radiating coating can be relative simple, but the coating may not dissipate heat efficiently. The quality of the coating may not be stable, and the price of the coating may be relatively high. Radiator brazing sheet may often be used for heat dissipating because it is compact and provides good heat-dissipating performance. However, installing a radiator brazing sheet requires complex fabrication processed. The radiator brazing sheet is also easily deformed. The cost of installing a radiator brazing sheet can be high.

Active heat-dissipating structures, such as fans, are often used to improve convection among components of the LED lamp to more efficiently dissipate heat. The advantages of using active heat-dissipating structures include good heat-dissipating performance. However, the heating dissipating structures may be bulky and expensive. In addition, the service time of the active heat-dissipating structures may not be stable. As a result, the service time of the heat-dissipating structures cannot be guaranteed. Electronic modules are also used for dissipating heat. Electronic modules are small and have good heat-dissipating performance, but the service time of the electronic modules is not stable.

The heat-dissipating methods for LED lighting devices need to be improved. The disclosed systems and methods are directed to solve one or more problems set forth above and other problems. The present disclosure provides an LED lighting device with a simple assembly, desired heating-dissipating performance, and low manufacturing cost.

BRIEF SUMMARY OF THE DISCLOSURE

One aspect or embodiment of the present disclosure provides an LED lighting device. The LED lighting device includes a lamp base, a glass shell, a heat-dissipating cup, a driving power source, an LED light source module, and an optical portion. The optical portion may be a suitable optical component used for converging or redirecting light, such as a lens. The LED light source module, the heat-dissipating cup, and the driving power source are arranged from top to bottom inside the glass shell. A top portion of the glass shell is connected to the optical portion and a bottom portion of the glass shell is connected to the lamp base. The heat-dissipating cup faces upwardly and an outer sidewall of the heat-dissipating cup forms a close contact with an inner sidewall of the glass shell. The LED light source module is fixed within the heat-dissipating cup. The driving power source is positioned under the heat-dissipating cup and a space is formed between the driving power source and the heat-dissipating cup.

Optionally, the heat-dissipating cup is supported by a stepped surface of the inner sidewall of the glass shell at a bottom of the heat-dissipating cup.

Optionally, the LED light source module are fixed in the heat-dissipating cup through screws, a bottom of the LED light source module forming a close contact with an inner surface of a bottom of the heat-dissipating cup.

Optionally, the heat-dissipating cup is made of one or more of aluminum, heat-conductive plastic, and ceramic.

Optionally, a thickness of a sidewall of the heat-dissipating cup is between about 1.5 to about 2.5 mm.

Optionally, a dielectric film is formed through a coating process on an outer sidewall of the glass shell, the dielectric film being made of a material with high heat-radiating performance.

Optionally, the dielectric film is treated with a sandblasting process.

Optionally, a creepage distance between an outer periphery of the heat-dissipating cup and an outer periphery of the glass shell is greater than 1.2 mm.

Optionally, an output terminal of the driving power source is electrically connected to a positive electrode and a negative electrode of an input terminal of the LED light source module through pins. An input terminal of the driving power source is connected to a power supply through certain terminals, the lamp base, or a combination of the certain terminals and the lamp base.

Optionally, heat generated by the LED light source module is dissipated by the glass shell through the close contact with the heat-dissipating cup.

Optionally, heat generated by the driving power supply is dissipated by the glass shell through the heat-dissipating cup.

Optionally, the optical portion is a lens.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

It should be noted that, in the present disclosure the LED lighting device is described according to a direction opposite of the direction when it is in operation.

LED lamps embed aluminum heat sink in insulating plastic to support heat dissipation functions. This addresses issues such as insulation, heat-dissipation, and cost. However, the method also raises other issues. For example, because the thermal expansion coefficients of the insulating plastic and the aluminum are different, after the LED lamp has been operating under adverse conditions for a certain amount of time, the insulating plastic often cracks or eroded on the surface, which may cause electric shock to users. In addition, generally, plastic often has poor heat-conductivity. Heat-conductive plastic may be expensive.

Figure 1:
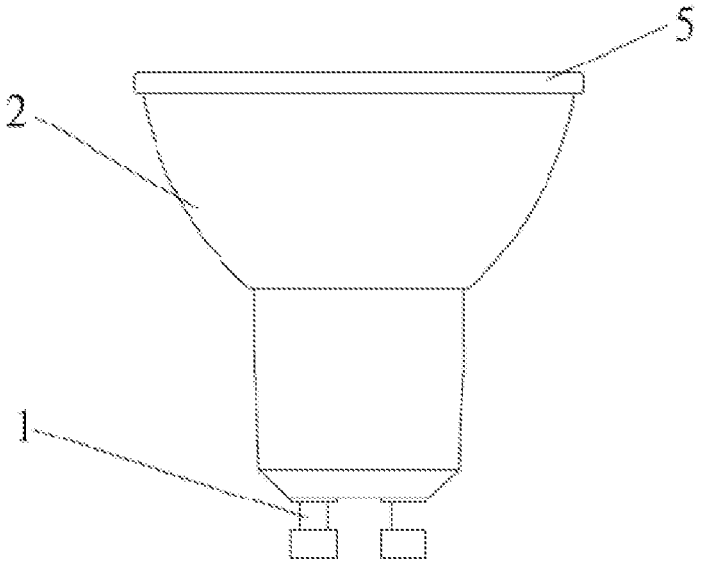
FIG. 1 illustrates a side view of an exemplary LED lighting device consistent with various disclosed embodiments.
Figure 2:
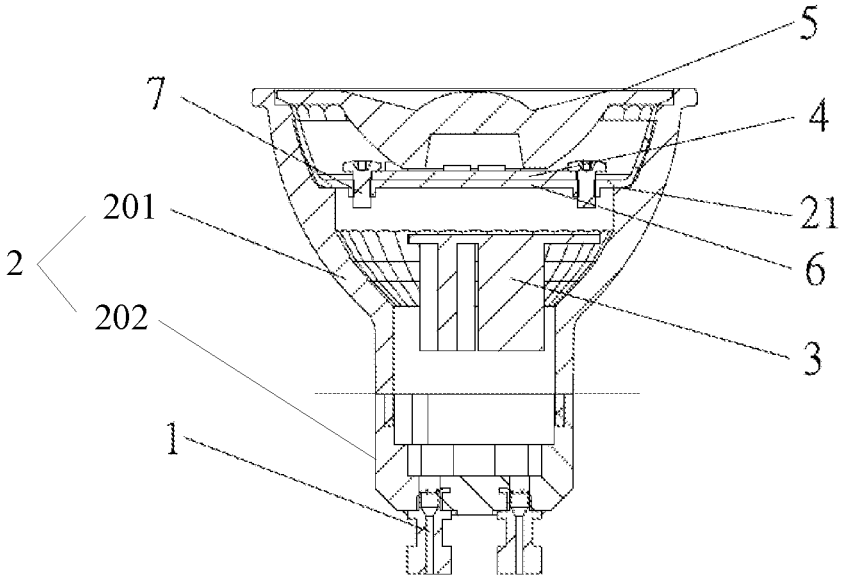
FIG. 2 illustrates a cross-sectional view of the LED lighting device in FIG. 1 along a direction perpendicular to the viewing direction.
Figure 3:
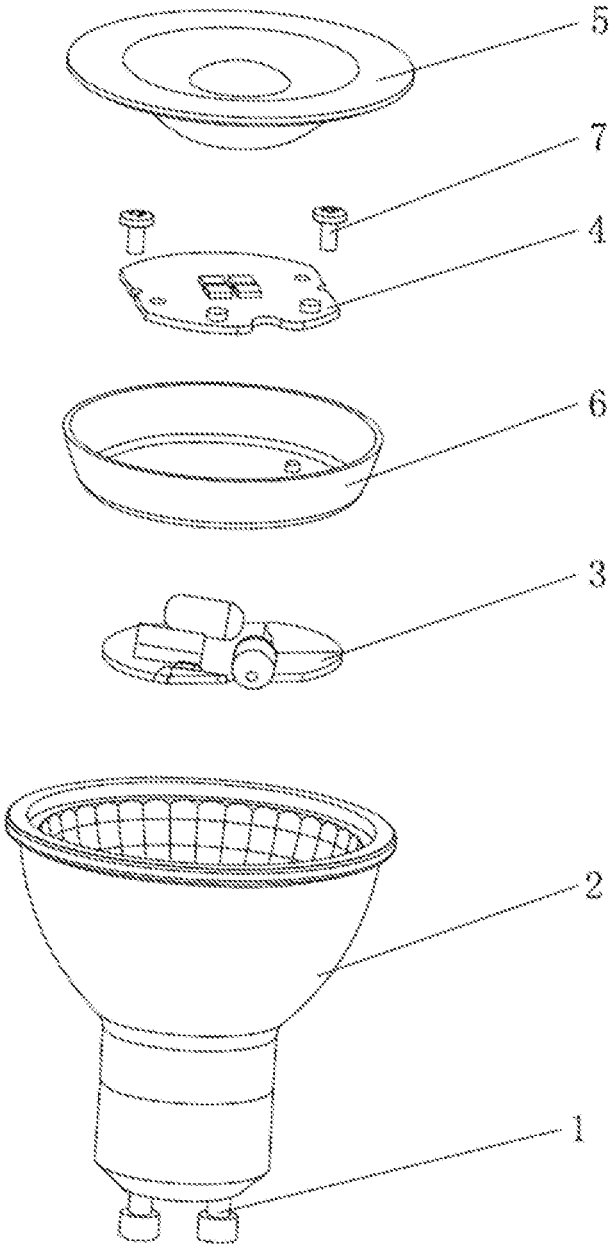
FIG. 3 illustrates an exploded view of the components in the LED lighting device consistent with various disclosed embodiments.

Embodiments of the present disclosure provide a highly efficient heat-dissipating LED lighting device, as shown in FIGS. 1-3. The LED lighting device includes a lamp base 1, a glass shell 2, a driving power source 3, an LED light source module 4, and an optical portion 5. It should be noted that, the glass shell 2 is only exemplary in the present disclosure. The shell may also be made of other suitable heat conducting insulating materials such as ceramics.

FIG. 2 is a cross-sectional view of the LED lighting device along a direction orthogonal to the viewing direction towards the LED lighting device and the cutting plane is through the center of the LED lighting device. As shown in FIG. 2, inside the glass shell 2, the LED light source 4 and the driving power source 3 may be arranged from top to bottom. The top portion of the glass shell 2 may be connected to the optical portion 5. The bottom portion of the glass shell 2 may be connected to the lamp base 1. Certain optics may be disposed on the LED light source module 4. The output terminal of the driving power source 3 may be electrically connected to the positive electrode and the negative electrode of the input terminal of the LED light source module 4 through pins. The input terminal of the driving power source 3 may be connected to the electric supply through certain terminals and/or through the lamp base 1.

In some embodiments, the glass shell 2 may include two portions, i.e., an upper portion 201 and a lower portion 202, connected through a suitable connection method. As shown in FIG. 2, for example, the upper portion 201 of the LED lighting device and the lower portion 202 of the LED lighting device may be connected through screws or latches. The connecting interface of the upper portion 201 and the lower portion 202 is indicated in FIG. 2 using a dashed line. In other embodiments, the glass shell 2 may have only one piece, i.e., the upper portion 201 and the lower portion 202 being an integral part. The upper portion 201 and the lower portion 202 of the LED lighting device may be made of a same material or different materials. The materials for forming the upper portion 201 and the lower portion 202 of the LED lighting device may be made of one or more heat conducting insulating materials.

In some embodiments, the glass shell 2 may be made of other materials or a combination of materials that are electrically nonconductive but thermally conductive. In some embodiments, the glass shell 2 may also include fins arranged inside or outside the lamp to help dissipate heat. In FIG. 3, referring to the glass shell 2, the inside of the lamp is shown with grids, and the outside of the lamp is shown with no grids. In some embodiments, the glass shell 2 may also include openings to enable air circulation around the LED light source module 4. The openings may be positioned away from the LED light source module 4, for example, on the bottom portion of glass shell 2 close to lamp bases 1.

For the LED lighting device to more efficiently dissipate heat, a heat-dissipating cup of a cooling cup 6 may be disposed on the stepped surface 21 of the inner sidewall of the glass shell 2. The heat-dissipating cup 6 may thus be supported by the stepped surface 21. That is, as shown in FIG. 3, inside the glass shell 2, the optical portion 5 may be arranged at the top of the glass shell 2 to converge or transmit light. Between the optical portion 5 and the glass shell 2, from top to bottom, the LED light source module 4, the heat-dissipating cup 6, and the driving power supply 3 may be arranged. The LED light source module 4 may be fixed into the heat-dissipating cup 6 through suitable fixed connections such as screws 7. The heat-dissipating cup 6 may be facing upwardly, i.e., the opening of the heat-dissipating cup 6 is facing upwardly. The heat-dissipating cup 6 may be made of aluminum. The thickness of the sidewall of the heat-dissipating cup 6 may be about 0.8 mm. The outer sidewall of the heat-dissipating cup 6 may be in close contact with the inner sidewall of the glass shell 2. The thickness of the heat-dissipating cup 6 and the glass shell 2 can be adjusted depending on the heat dissipation requirement. For example, for a higher-powered LED light source module 4, a thicker heat-dissipating cup 6 and/or a thicker glass shell 2 may be used to dissipate more heat.

The bottom of the LED light source module 4 may form a close contact with an inner surface of the bottom of the heat-dissipating cup 6. The bottom surface of the LED light source module 4 may be bonded and fixed into the heat-dissipating cup 6. The driving light source 3 may be arranged to be under the heat-dissipating cup 6. Space may be formed between the driving light source 3 and the heat-dissipating cup 6. For safety purposes, the creepage distance between the outer periphery of the heat-dissipating cup 6 and the outer periphery of the glass shell 2 may be greater than 1.2 mm. In one embodiment, the creepage distance may be about 2 mm.

Further, the LED light source module 4 may form fixed connections with the heat-dissipating cup 6 through any suitable methods such as screws 7. The bottom surface of the LED light source module 4 may be in a close contact with the inner bottom surface of the heat-dissipating cup 6. Optionally, the outer sidewall of the glass shell 2 may undergo coating processes and/or sandblasting processes. A dielectric film may be coated on the outer sidewall of the glass shell 2, and a sandblasting process may be performed on the dielectric film to polish the dielectric film. The dielectric film may be made of a highly heat-radiating material so that heat transferred to the glass shell 2 may be more efficiently exchanged or dissipated into the outside environment through the dielectric film. The dielectric film may be made of any suitable material with high heat-radiating performance.

The heat-dissipating parts of the LED lighting device provided by the present disclosure may include the glass shell 2 and the heat-dissipating cup 6. The outer sidewall of the heat-dissipating cup 6 may be in close contact with the inner sidewall of the glass shell 2. The heat-dissipating cup 6 may be highly heat-conductive. The heat-dissipating cup 6 may conduct the heat generated by the LED light source module 4 to the glass shell 2 within a desirably short time. Because the outer surface of the glass shell 2 may undergo coating processes and/or sandblasting processes and may be deposited with a polished dielectric film with highly heat-radiating performance, the glass shell 2 may have desired heat conducting, heat convection, and heat radiating performance. The overall heat-dissipating performance of the LED lighting device may be greatly improved. Further, because the glass shell 2 is made of an insulating material, non-isolated power supply, with low cost, may be used in the disclosed LED lighting device. Meanwhile, the LED lighting device may ensure highly efficient heat dissipation. In addition, the heat-dissipating cup 6 may be made of a highly heat-conductive material such as aluminum, heat-conductive plastic, and/or ceramic. The lighting performance of the LED lighting device may be further improved, and the cost of the LED lighting device may be further reduced.

In operation, the driving power supply 3 may supply electric currents to the LED light source module 4. The LED light source module 4 may emit light and generate heat. The light generated by the LED light source module 4 may be converged/redirected by the optical portion 5 and transmitted to the outside environment. Meanwhile, the heat generated by the LED light source module 4 may be conducted to the glass shell 2 through the heat-dissipating cup 6. Because the LED light source module 4 forms fixed connections with the heat-dissipating cup 6, heat generated by the LED light source module 4 may be well conducted to the heat-dissipating cup 6 such that the LED light source module 4 would not be over heated. Further, because the heat-dissipating cup 6 forms a close contact with the glass shell 2, the heat, generated by the LED light source module 4 and conducted to the heat-dissipating cup 6, may be transferred efficiently to the glass shell 2. The glass shell 2, coated with a highly heat-radiating dielectric film on the outside surface, may have desired heat-conductive and heat-radiating performances so that the heat can be exchanged or dissipated to the outside environment more efficiently.

In some embodiments, suitable heat-conductive materials may also be used for the optical portion 5. A portion of the heat generated by the LED light source 4 can then be dissipated through optical portion 5, which improves the heat dissipation performance of the lamp.

In some embodiments, the glass shell 2 may have slots/lips on the outside so that the lamp may be clipped in with another external heat sink part to further improve the performance of heat dissipation of the LED lighting device. The glass shell 2 may also have tracks so that it may be screwed in with an external heat sink part.

In some embodiments, suitable heat-conductive materials may be used to form contact between the heat-dissipating cup 4 and the glass shell 2 to improve heat transfer. The choice of the specific materials may be determined or adjusted according to different applications and should not be limited by the embodiments of the present disclosure.

It should be noted that, because the heat-dissipating cup 6 is made of a material with the thermal conductivity greater than 1, such as aluminum, the heat-dissipating cup 6 has desired heat-conductive performance. That is, the heat-dissipating cup 6 may also conduct or transfer heat generated by the driving power supply 3. For example, heat generated by the driving power supply 3 may dissipate in the space between the driving power supply 3 and the bottom of the heat-dissipating cup 6, as shown in FIG. 2. The heat-dissipating cup 6 may also conduct at least a portion of the heat generated by the driving power supply 3 to the glass shell 2. Thus, the lighting performance of the LED lighting device may be further improved, and the cost of the LED lighting device may be further reduced.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

The disclosed LED heat-dissipating LED lighting device has several advantages. For example, the disclosed LED heat-dissipating LED lighting device may have a simple structure, desired heat-dissipating performance, and low manufacturing cost. The heat-dissipating cup may have the desired heat-conduction rate. By fixing the LED light source module in the heat-dissipating cup, the outer surface of the heat-dissipating cup may form a close contact with the inner surface of the glass shell. Heat generated by the LED light source module may be conducted to the glass shell, having a close contact with the heat-dissipating cup, within a desirably short time through the heat-dissipating cup. Because the glass shell is electrically non-conductive but has desirable heat conducting, heat convection, and heat radiating performances, the glass shell is safe to use and may dissipate heat into the outside environment. The heat-dissipating performance of the disclosed LED lighting device may be effectively improved.

Further, the heat-dissipating cup may be made of suitable materials with thermal conductivity greater than 1, e.g., aluminum and heat-conductive plastic. The materials for forming the heat-dissipating cup have desired heat-conductive performance with low cost.

Additionally, the LED lamp may be clipped or screwed into an external heat sink part as needed to further improve its heat dissipation performance. The glass shell of the LED lamp may have slots, lips, or screw tracks on the outside wall so that the lamp can be thermally connected to an external heat sink part.

REFERENCE SIGN LIST

Lamp base 1
Glass shell 2
Driving power supply 3
LED light source module 4
Optical portion 5
Heat-dissipating cup 6
Screws 7
Stepped surface 21

What is claimed is:

1. A light-emitting diode (LED) lighting device, comprising: a lamp base, a glass shell, a heat-dissipating cup, a driving power source, an LED light source module, and an optical portion, wherein:

the LED light source module, the heat-dissipating cup, and the driving power source are arranged from top to bottom inside the glass shell, a top portion of the glass shell being connected to the optical portion and a bottom portion of the glass shell being connected to the lamp base;

the heat-dissipating cup includes a planar bottom and a sidewall to form a cup shape that faces upwardly, and an outer surface of the sidewall of the heat-dissipating cup forms a contact with an inner portion of the glass shell;

the LED light source module is fixed onto the heat-dissipating cup, a bottom of the LED light source module being in contact with a top surface of the planar bottom of the heat-dissipating cup; and the driving power source is positioned under the heat-dissipating cup and a space is formed between the driving power source and the heat-dissipating cup.

2. The LED lighting device according to claim 1, wherein the heat-dissipating cup is supported by a stepped surface on an inner surface of a sidewall of the glass shell at a bottom of the heat-dissipating cup.

3. The LED lighting device according to claim 1, wherein the LED light source module are fixed in the heat-dissipating cup through screws.

4. The LED lighting device according to claim 1, wherein the heat-dissipating cup is made of one or more of aluminum, heat-conductive plastic, and ceramic.

5. The LED lighting device according to claim 1, wherein a thickness of the sidewall of the heat-dissipating cup is between about 1.5 mm to about 2.5 mm.

6. The LED lighting device according to claim 1, wherein a dielectric film is formed through a coating process on an outer surface of the sidewall of the glass shell, the dielectric film being made of a material with high heat-radiating performance.

7. The LED lighting device according to claim 6, wherein the dielectric film is treated with a sandblasting process.

8. The LED lighting device according to claim 1, wherein a creepage distance between an outer periphery of the heat-dissipating cup and an outer periphery of the glass shell is greater than 1.2 mm.

9. The LED lighting device according to claim 1, wherein:

an output terminal of the driving power source is electrically connected to a positive electrode and a negative electrode of an input terminal of the LED light source module through pins; and an input terminal of the driving power source is connected to a power supply through certain terminals, the lamp base, or a combination of the certain terminals and the lamp base.

10. The LED lighting device according to claim 1, wherein heat generated by the LED light source module is dissipated by the glass shell through the contact with the heat-dissipating cup.

11. The LED lighting device according to claim 10, wherein heat generated by the driving power supply is dissipated by the glass shell through the heat-dissipating cup.

12. The LED lighting device according to claim 1, wherein the optical portion is a lens.

13. A light-emitting diode (LED) lighting device, comprising: a lamp base, a glass shell, a heat-dissipating cup, a driving power source, an LED light source module, and an optical portion, wherein:

the LED light source module, the heat-dissipating cup, and the driving power source are arranged from top to bottom inside the glass shell, a top portion of the glass shell being connected to the optical portion and a bottom portion of the glass shell being connected to the lamp base;

the heat-dissipating cup includes a planar bottom and faces upwardly, and an outer surface of a sidewall of the heat-dissipating cup forms a contact with an inner portion of the glass shell;

the inner surface of the sidewall of the glass shell includes a planar step, and a portion of a bottom surface of the planar bottom of the heat-dissipating contacts the planar step of the glass shell for a support;

the LED light source module is fixed onto the heat-dissipating cup; and the driving power source is positioned under the heat-dissipating cup and a space is formed between the driving power source and the heat-dissipating cup.

* * * * *